US006435369B1

(12) United States Patent
Poursayadi

(10) Patent No.: US 6,435,369 B1
(45) Date of Patent: Aug. 20, 2002

(54) DEVICE FOR PLACING CONES ON A ROADWAY SURFACE

(76) Inventor: Farid Poursayadi, 147 N. Sparks St., Burbank, CA (US) 91506

( * ) Notice: Subject to any disclaimer, the term of this patent is extended or adjusted under 35 U.S.C. 154(b) by 0 days.

(21) Appl. No.: 09/311,334

(22) Filed: May 13, 1999

(51) Int. Cl.[7] ..... A24F 1/00
(52) U.S. Cl. ..... 221/185; 414/551
(58) Field of Search ..... 221/185, 221, 221/222, 223; 414/551, 788.2, 795.6, 789.7, 440, 502; 198/512, 518, 624

(56) References Cited

U.S. PATENT DOCUMENTS

| | | | | |
|---|---|---|---|---|
| 3,750,900 A | | 8/1973 | Piercey | 214/6 B |
| 4,967,930 A | * | 11/1990 | Koltze | 221/222 |
| 5,054,648 A | | 10/1991 | Luoma | 221/185 |
| 5,213,464 A | | 5/1993 | Nicholson et al. | 414/440 |
| 5,244,334 A | | 9/1993 | Akita et al. | 414/502 |
| 5,525,021 A | * | 6/1996 | Larguler | 414/551 |

* cited by examiner

*Primary Examiner*—Kenneth W. Noland
(74) *Attorney, Agent, or Firm*—Christie, Parker & Hale, LLP

(57) ABSTRACT

A device for setting cones on a roadway surface having a lower base portion and an upwardly extending cone extension. The device includes a chute portion having an upper end and a lower end, a feeder portion adapted to release cones one at a time from the upper end to the lower end of the chute portion to set cones on a roadway surface. The device also has a hopper portion adapted for holding a plurality of stacked cones above the feeder portion, wherein in the plurality of stacked cones the base portions are spaced apart, a motive portion to activate the feeder portion, and a control module to control the motive portion and release individual cones at a desired spaced apart interval.

21 Claims, 5 Drawing Sheets

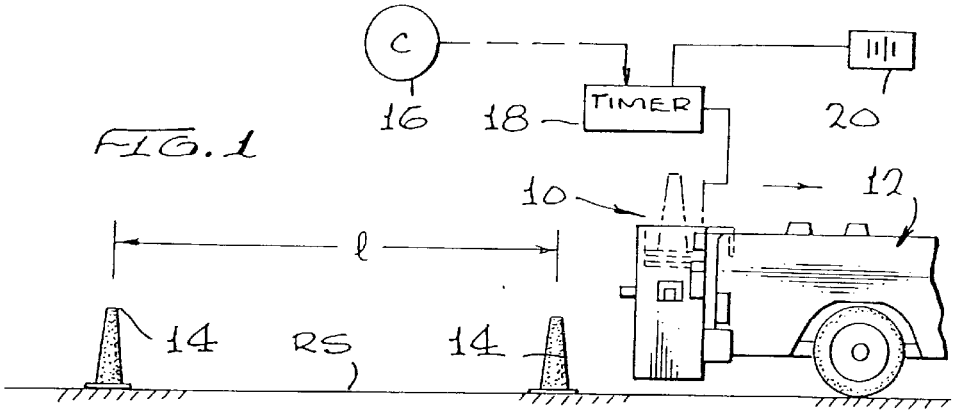
FIG. 1
FIG. 3
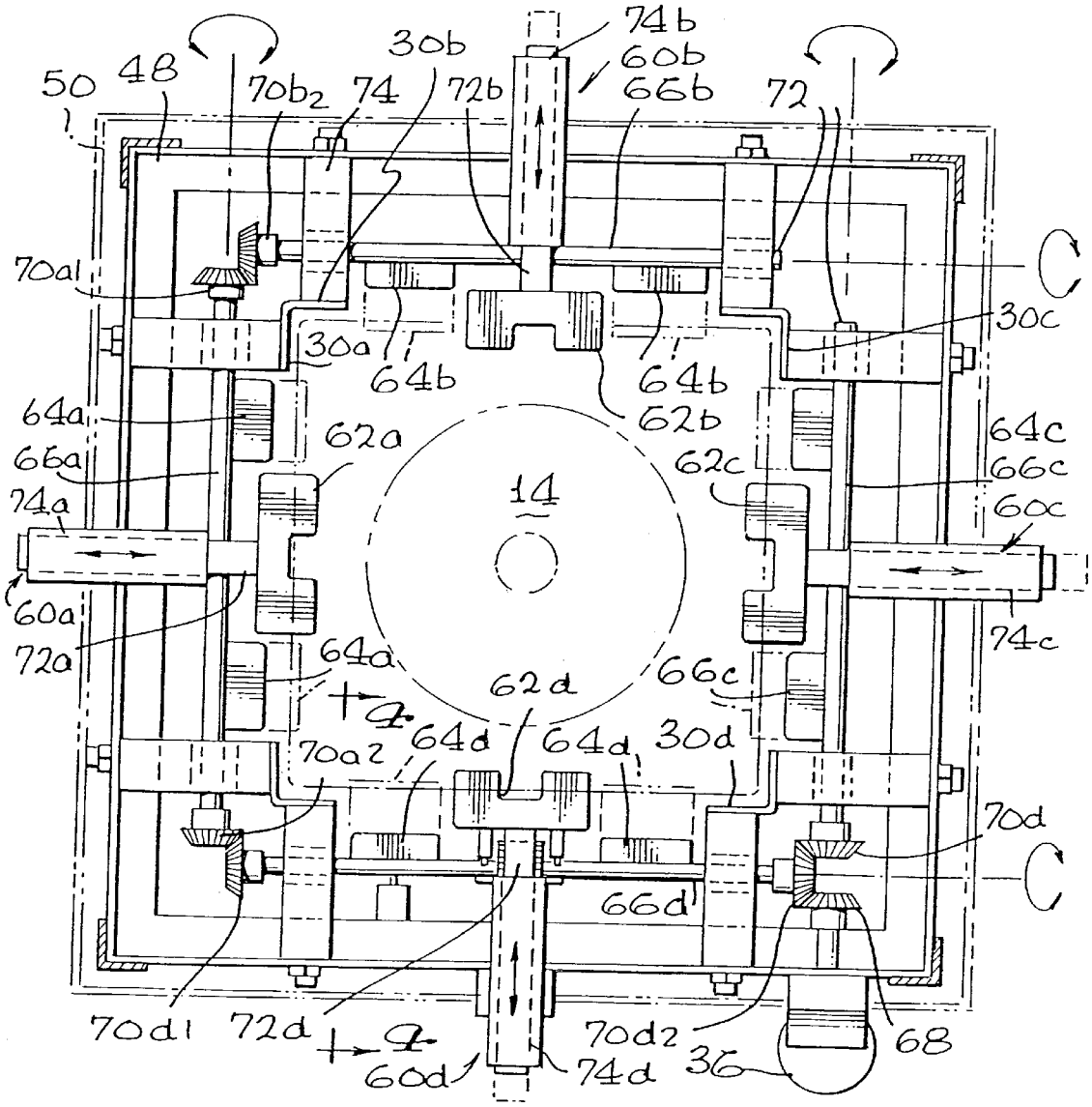

FIG. 4
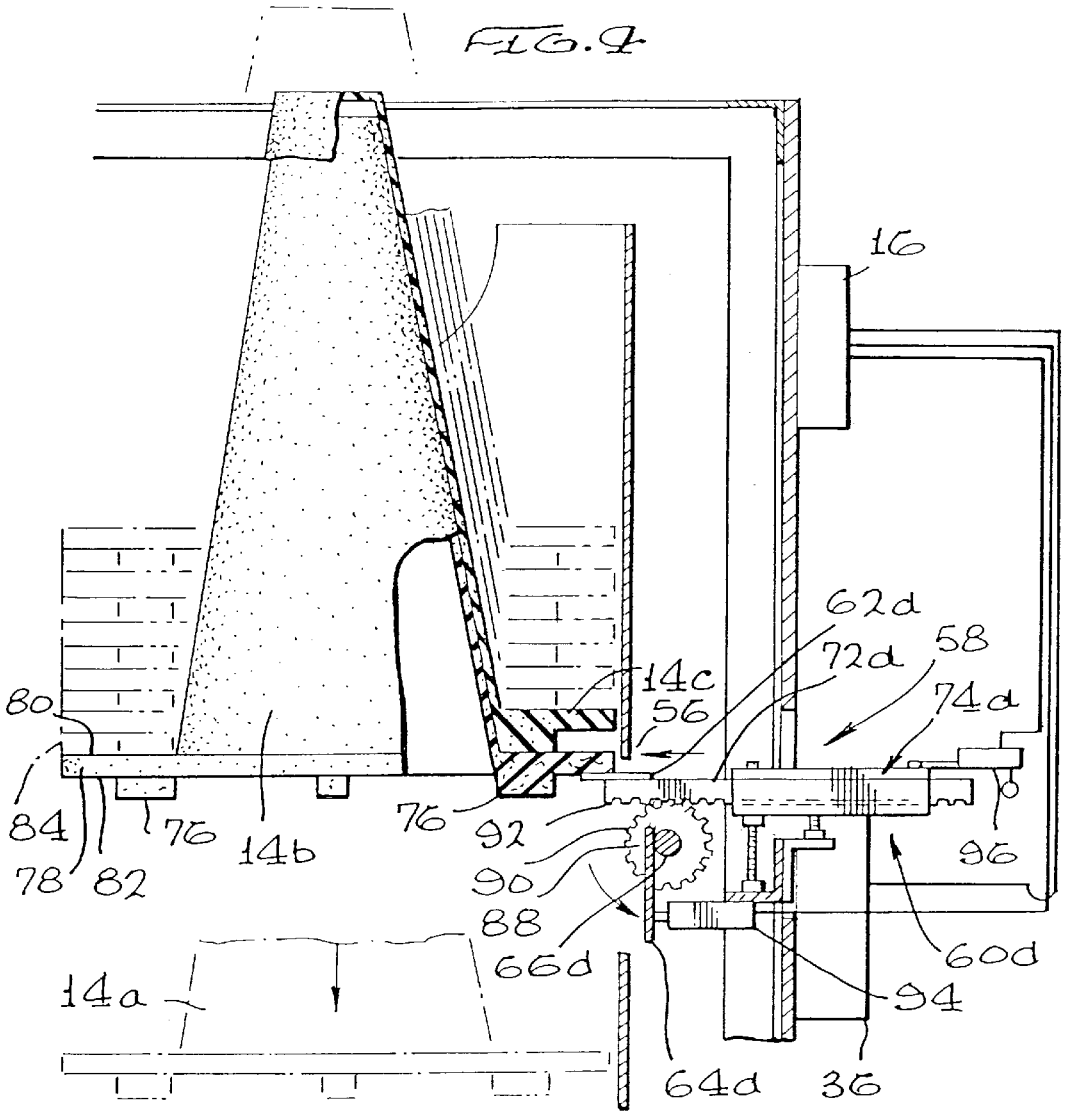
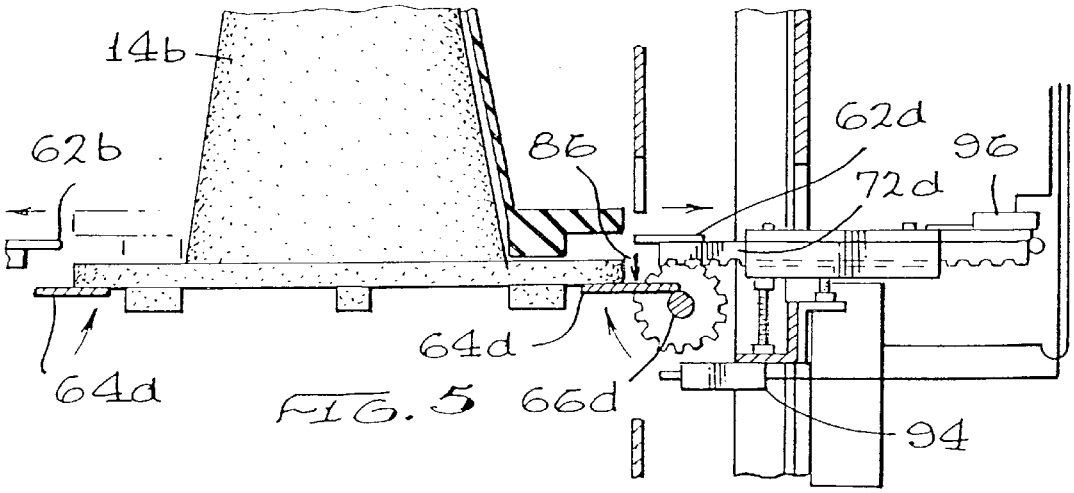
FIG. 5

DEVICE FOR PLACING CONES ON A ROADWAY SURFACE

BACKGROUND OF THE INVENTION

1. Field of the Invention

The invention relates to the field of roadway safety, and more particularly to devices to place cones and other removable markers on a roadway surface.

2. Description of Related Arts

Roadway markers, such as cones (which are stackable in a nestable manner), and other structures are widely used in the United States and other countries to enhance the safety of workers during road construction and repair, to close lanes in the vicinity of accident sites, and for a myriad of other purposes. A number of devices have been developed to automatically set roadway markers on roadway surfaces. These include the following:

U.S. Pat. No. 5,054,648 to Luoma and U.S. Pat. No. 5,213,464 to Nicholson et al. disclose cone dispensing and collecting devices that are mounted to a truck. In the case of the Luoma device, it includes two rotatable cone conveyors that can be set off on one side of a pickup's bed. It relies on the two closely spaced together and rotating discs to pick up and set roadway cones. The Nicholson et al. reference discloses a device that is similar to the Luoma device, except that it is much larger and more complicated. Both devices appear to function in a similar manner. The Nicholson et al. device is connected to the back of a flatbed truck, and can be swung back onto the truck when not in use.

U.S. Pat. No. 3,750,900 to Piercey discloses a specialized vehicles that functions as a traffic cone retriever. Is has a catcher portion at the front of a conveyor system that slants from the front to the back of the specialized vehicle. The device requires that the vehicle be driven directly into the path of the cones to be retrieved.

U.S. Pat. No. 5,244,334 to Akita et al. discloses an apparatus for setting and removing cones on a roadway. It includes a conveyor belt system on the back of a flat bed truck, and a cone lowering and setting mechanism. The mechanism includes hydraulically activated arms that drop and swing out and release the cone.

U.S. Pat. No. 5,525,021 to Larguier discloses a truck mounted device for setting and removing cones on a roadway. The Larguier device includes a carousel unit that has multiple chutes with a number of stacked and nested cones inside. A forked finger unit allows only one cone at a time to be dropped onto the roadway surface. When the cones are first dropped on the roadway surface, they are laying on their side. Another part of the apparatus later "rights" the cone on the roadway surface.

A common feature of all these devices is that they include a dedicated vehicle and are relatively complete in design and operation. It is therefore not surprising that most highway authorities, such as the California Department of Transportation and other larger organizations continue to rely on manual methods to set and pick up highway cones. This is typically accomplished as follows: One worker drives a truck (such as a flatbed or pickup truck with cones stacked in the back), while another worker sits on the back of the truck and reaches over the side of the truck to either place or pick up the cones, all while the truck is driven relatively slowly. This requires the worker on the back of the truck to reach out from the side of the truck, exposing the worker to excessive strain, injury, and in rare cases, dangerous contact with other passing vehicles. In order to allow the worker on the back of the truck to safely place and retrieve cones, the truck must be driven at a relatively slow pace (or alternately speed up and slow down). The manual process for setting up and picking up roadway cones is slow, labor intensive, and is disruptive to the flow of traffic. These add up to increased labor costs, benefits costs, insurance, and legal costs. In addition, there is the inevitable traffic delays and disruptions during the setting process. Indeed, since the process to lay or pick up a long line of cones is time consuming, very often the process begins long in advance of the actual need for the cones, which further disrupts traffic.

There accordingly remains a need for a simple, low cost, and reliable device to set roadway cones in a fast, safe, and reliable manner.

SUMMARY OF THE INVENTION

On object of the invention is to provide a simple, low cost, and reliable device for use in setting roadway cones on a roadway surface.

Another object of the invention is to provide a device for use in setting roadway cones on a roadway surface that can be detachably fitted to a standard vehicle to avoid the need for a dedicated vehicle.

Yet another object of the invention is to provide a device for use in setting roadway cones on a roadway surface that can be used with or without an optional conveyor system to reload the device with stacks of nested roadway cones.

A further object of the invention is to provide a device for use in setting roadway cones on a roadway surface that can be loaded with a stack of cones but will set a single cone at a time a desired distance apart.

These and other objects of the invention are satisfied by providing a cone setting device including a hopper portion for holding a plurality of stacked cones, a feeder portion that ensures that a single cone is dropped at a time, a chute alignment portion through which individual cones will drop and be set on a roadway surface, motive means to activate the feeder portion, and control means to control the motive means.

The device alternatively includes a conveyor means to deliver stacks of cones to the hopper portion to provide for automatic reloading of the hopper with stacks of cones.

BRIEF DESCRIPTION OF THE DRAWINGS

FIG. 1 is a diagrammatic side view showing the cone setting device on the back of a pickup truck setting cones on a roadway surface.

FIG. 3 is a top perspective view showing a first embodiment of the device through view lines 3—3 of FIG. 2 with a stack of cones (shown in phantom) placed in the hopper of the device.

FIG. 4 is a side perspective view showing the first embodiment of the device through view lines 4—4 of FIG. 3 with the upper feeder support in the extended position to support the stack of cones above the lowest cone and the lower feeder support in the retracted position to permit the lowest cone to drop through the chute.

FIG. 5 is a side perspective view showing the first embodiment of the device through view lines 4—4 of FIG. 3 with the upper feeder support in the retracted position to allow the stack of cones to drop onto the lower feeder support in the extended position to prevent cones from dropping through the chute.

DISCUSSION OF THE PREFERRED EMBODIMENT

Figure 2:
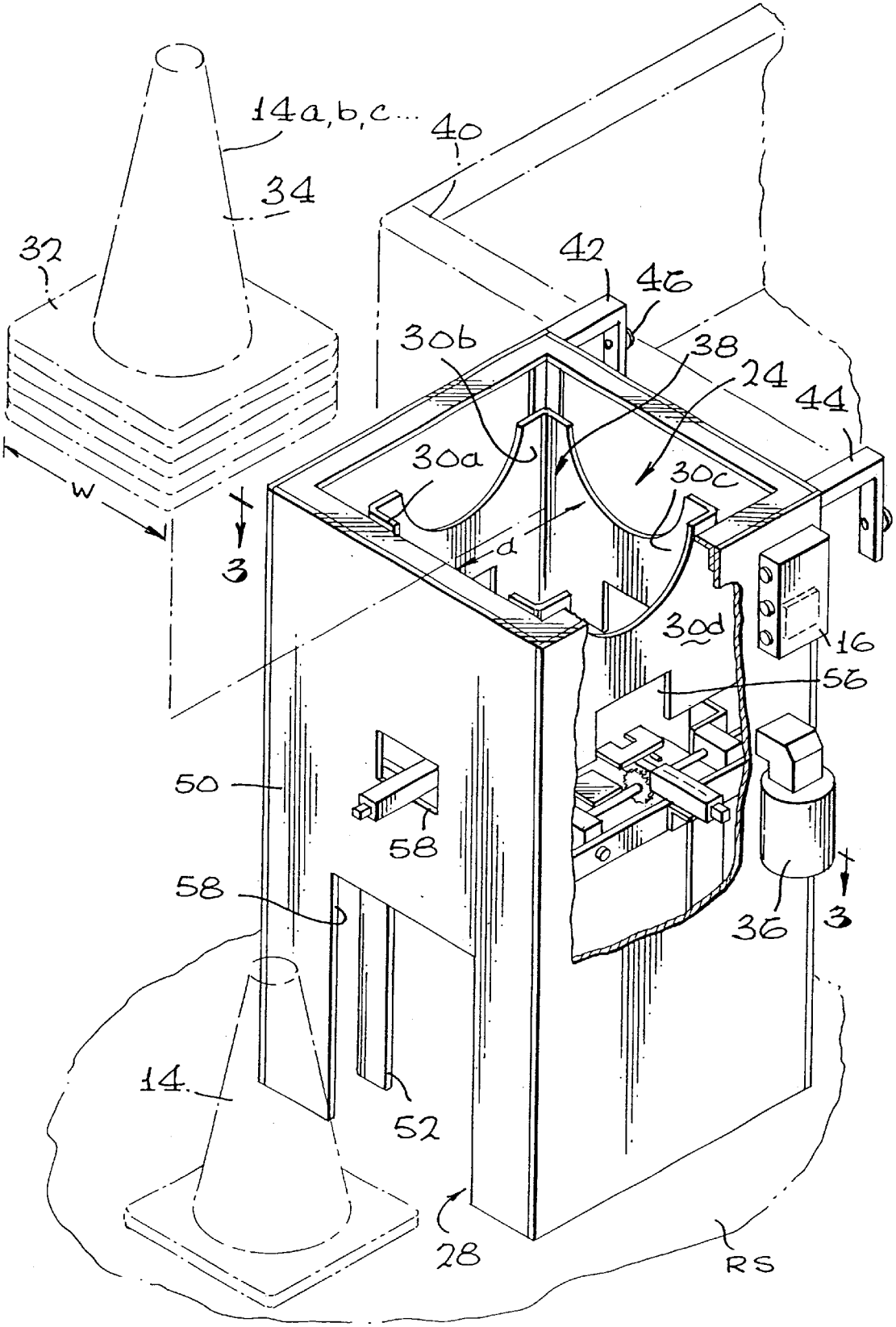
FIG. 2 is a partial top right perspective view showing features of a first embodiment of the device, with portions cut away to show details of the feeder portion of the device, as well as a stack of cones in phantom.

Turning first to FIG. 1, there is shown a diagrammatic side view showing the device 10 of the invention on the back of a pickup truck 12 setting cones 14 on a roadway surface RS. The device 10 includes a control portion 16 including a timer circuitry 18, activated by a power source, such as the vehicles battery or an accessory battery 20. Device 10 is shown loaded with a stack of cones 14. As shown, device 10 is adapted to place cones 14 at a desired spacing L on roadway surface RS.

Referring now to FIG. 2 is a partial top right perspective view showing features of a first embodiment of device 10, with portions cut away to show a feeder portion 22 of device 10. Device 10 has a chute portion 24 with an upper end 26 and a lower end 28. Chute portion 24 has spaced apart inner walls 30*a*, 30*b*, 30*c* and 30*d*, preferably arranged to form a chute having a square cross section (see FIG. 3), with opposing walls 30*a* and 30*c*, and 30*b* and 30*d* being set apart a distance D slightly larger than the width W of a lower base portion 32 of the cones 14. Each cone 14 has an upwardly extending cone portion 34 that extends upwardly from the lower base portion 32. The cones 14 are nestable when stacked. Motive means 36 to activate the feeder portion 22 can conveniently comprise a reversible electric motor, such as a 12 volt D.C. motor, but can also comprise other motive means, such as a compressed gas or fluid to supply pneumatic or hydraulic activators, valves, and the like (as will be described in greater detail further below with respect to other embodiments of the invention.) That region of chute portion 24 above feeder portion 22 can be considered a hopper portion 38. In order to allow optional detachable attachment of the device 10 to a vehicle 12, such as to the tailgate 40 of a pickup truck, detachable attachment means 42 extends from the back of the device 10, and can comprise arms 44 that hang on and tightly engage with the tailgate 40. Adjustment means 46, such as adjustment knurls, can be used to set the correct angle and height of the device 10 off of the roadway surface RS. Chute portion 24 is secured within a framework 48 of the device 10. Feeder portion 22 is also affixed to framework 48. Framework 48 can conveniently be surrounded with a cover panels 50 to protect chute portion 24 and feeder portion 22 from possible damage and the elements. Control means 16 can be mounted to cover panels 50. As shown, chute wall 30*c* faces the tailgate 40 of the truck 12 and chute wall 30*a* faces out towards the back of the truck 12. A cone cutout 52 is formed in the lower portion of chute wall 30*a* and a cover panel cutout 54 is formed on the cover panel 50 on the back wall of the device 10. The cone cutout 52 and cover panel cutout 54 are sized larger than the cone 14 so that when a cone 14 is dropped through the device 10 and onto the roadway surface RS, and the truck drives forward, the cone 14 will be stabilized on the roadway surface RS in an upright manner and will be allowed to pass through the cone cutout 52 and cover panel cutout 54. Chute wall feeder portion cutouts 56 are formed in the chute walls 30*a*, 30*b*, 30*c*, and 30*d*, and cover panel feeder portion cutouts 58 are formed in the cover panels 50. Those portions of feeder portion extending from the cover panel feeder portion cutouts 58 can be surrounded with protective enclosure portions (not shown.)

Next, turning to FIG. 3, there is shown a top perspective view showing the first embodiment of device 10 through view lines 3—3 of FIG. 2 with a stack of cones 14 (shown in phantom) placed in the hopper portion 38 of device 10, and shows additional parts of feeder portion 22 and motive means 36. Feeder portion 22 comprises four feeder support units 60*a*, 60*b*, 60*c*, and 60*d*, each with an upper feeder supports 62*a*, 62*b*, 62*c*, and 62*d*, and lower feeder supports 64*a*, 64*b*, 64*c*, and 64*d* connected to axles, or driven shafts 66*a*, 66*b*, 66*c*, and 66*d*. In the preferred embodiment, the reversible D.C. electric motor of motive means 36 is connected to a drive bevel gear 68. Affixed on both ends of each driven shafts 66*a* and 66*d* are driven bevel gears 70*a*1, 70*a*2, 70*d*1, and 70*d*2, respectively. Drive shafts 66*b* and 66*c* do not have driven bevel gears 70 located on their two adjacent ends 72 and only have driven bevel gears 70*b*2, and 70*c*1. Driven bevel gear 70*a*2 on driven shaft 66*a* intermeshes with driven bevel gear 70*d*1 of driven shaft 60*d*. Driven bevel gear 70*b*2 on driven shaft 66*b* intermeshes with driven bevel gear 70*a*1 of driven shaft 60*a*. Driven bevel gear 70*c*1 on driven shaft 66*c* intermeshes with driven bevel gear 70*d*2 of driven shaft 60*d*, and both driven bevel gears 70*c*1 and 70*d*2 are driven by drive bevel gear 68 connected to motive means 36. Driven shafts 66*a*, 66*b*, 66*c*, and 66*d* are rotatably carried in low friction units, such as bearing units 74. These bearing units 74 are preferably supported on a portion of framework 48. Turning of drive bevel gear 68 in one direction (such as a clockwise direction) will thus cause a clockwise rotation of driven shafts 66*a*, 66*b*, 66*c*, and 66*d* (and vice versa.) Upper feeder support 62*a*, 62*b*, 62*c*, and 62*d* are carried on slide bars 72*a*, 72*b*, 72*c*, and 72*d* which slide in slide bar carriers 74*a*, 74*b*, 74*c*, and and 74*d*, respectively. Slide bar carriers 74*a*, 74*b*, 74*c*, and 74*d* are affixed to framework 48 and also act to retain the walls 30*a*, 30*b*, 30*c*, and 30*d* of chute 24 in a spaced apart orientation from the framework 48. Additional spacers (not shown) can be provided at other positions. As stated above, opposite side walls of chute 30*a* and 30*c*, and 30*b* and 30*d* are spaced apart a distance D that is greater than the width W of the square base portion 32 of the cones 14. Upper feeder supports 62*a*, 62*b*, 62*c*, and 62*d* are shown in their extended position, and as shown, extend into the space defined by the width W of the square base portion 32 of the cones 14 in the hopper 38. The lower feeder supports 64*a*, 64*b*, 64*c*, and 64*d* are shown in their retracted position and are out of the way of the space defined by the width W of the square base portion 32 of the cones 14 in the hopper 38.

Referring to FIGS. 4 and 5, there are shown two side, perspective detail views of the first embodiment of the device 10 through view lines 4—4 of FIG. 3. In FIG. 4, the upper feeder support 62*d* is shown in its extended position to support the stack of cones 14 above the lowest cone 14*b* that has not yet begun to drop through the lower portion of chute portion 24 and the lower feeder support 64*d* is shown in the retracted position to permit the lowest cone 14*a* to drop through the chute 24. As shown in FIG. 5, the upper feeder support 62*d* is shown in its retracted position and the lower feeder support 64*d* is in the extended position, so as to allow the stack of cones 14 above the lowest cone 14*b* to drop onto the lower feeder support 64*d* through the lower portion of chute portion 24 and the lower feeder support 64*d* is in the retracted position to permit the lowest cone 14*a* to drop through the chute. As can be best seen in FIGS. 4 and 5, the lower base portion 32 has feet 76 extending downwardly from a platform portion 78 with an upper side 80 and a lower side 82. When stacked, the feet 76 of an upper cone 14*c* sit on the upper side 80 of platform portion 78 of cone 14*b*, such that a space 84 remains between stacked cones 14. As can be seen, the spacing 86 between the top surfaces of the upper feeder support 62*d* and lower feeder support 64, when they are parallel (as shown in FIG. 5), is slightly less than that of space 84. As shown in FIGS. 4 and 5 a ratchet gear 88 is affixed on driven shaft 66*d*. Ratchet gear 88 has teeth 90 which engage with a ratchet surface 92 on underside of slide bar 72*d*. As driven shaft 66*d* is turned counterclockwise, the slide bar 72*d* and its attached upper feeder support 62*d* are moved inwardly, and the lower feeder support 64 attached to driven shaft 66*d* swings downwardly, as shown in FIG. 4. A lower position switch 94 detects when lower feeder support 64 is in its retracted position, and sends a signal to control portion 16 to reverse the direction of rotation of driven shaft 66*d* to a clockwise direction (e.g. by changing the direction of the reversible D.C. motor 36.) This causes the upper feeder support 62*d* to be moved rearwardly and the lower feeder support 64*d* to be moved from its generally downwardly directed retracted position to its generally horizontal extended position, as shown in FIG. 5. An upper position switch 96 detects when upper feeder support 62*d* is in its retracted position, and sends a signal to control portion 16 which then stops the rotation of driven shaft 66*d* for a desired time interval (to allow the vehicle to move forward before another cycle is begun.) After a desired time interval, the control portion 16 will cause the reversible D.C. motor 36 to move driven shaft 66*d* in a counterclockwise direction once again, to repeat the cycle.

Figure 6:
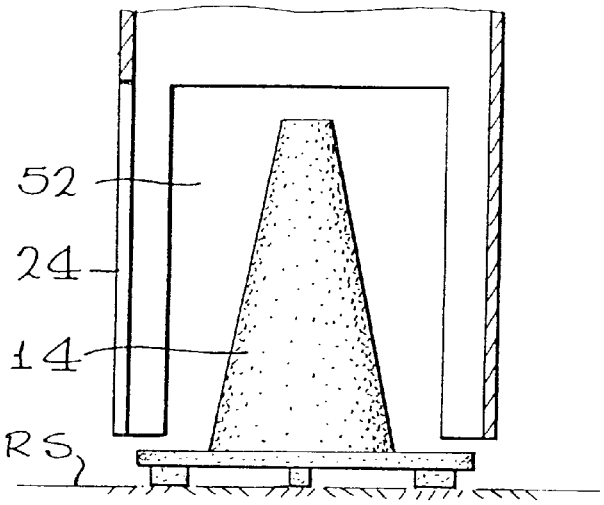
FIG. 6 is a front perspective view of the chute portion of the device with a cone placed on a roadway surface.

FIG. 6 is a front perspective view of the lower part of the chute portion 24 of the device with a cone 14 placed on a roadway surface. The chute portion 24 helps ensure that the cones 14 dropped on the roadway surface RS are steadied and do not tip over.

Figure 7:
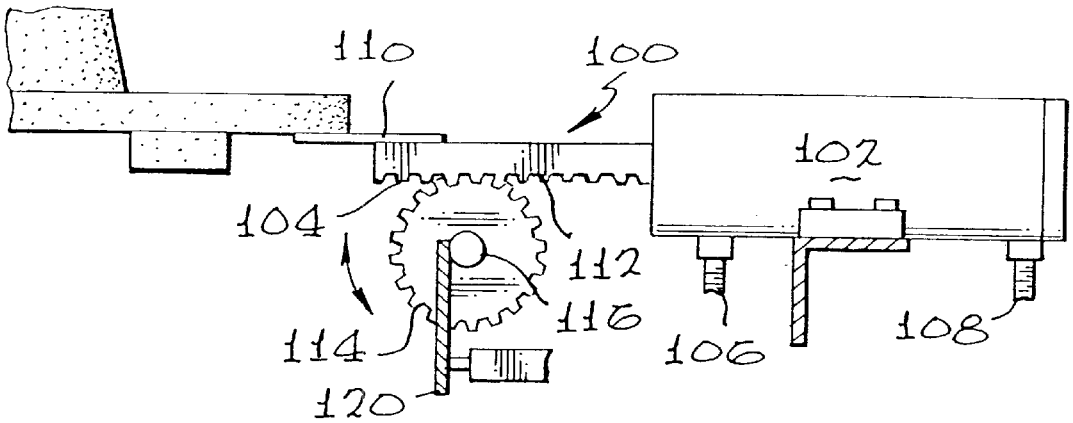
FIG. 7 is a detail showing a side view of an alternate embodiment of the device with a feeder portion that is activated by pneumatic or hydraulic means.
Figure 8:
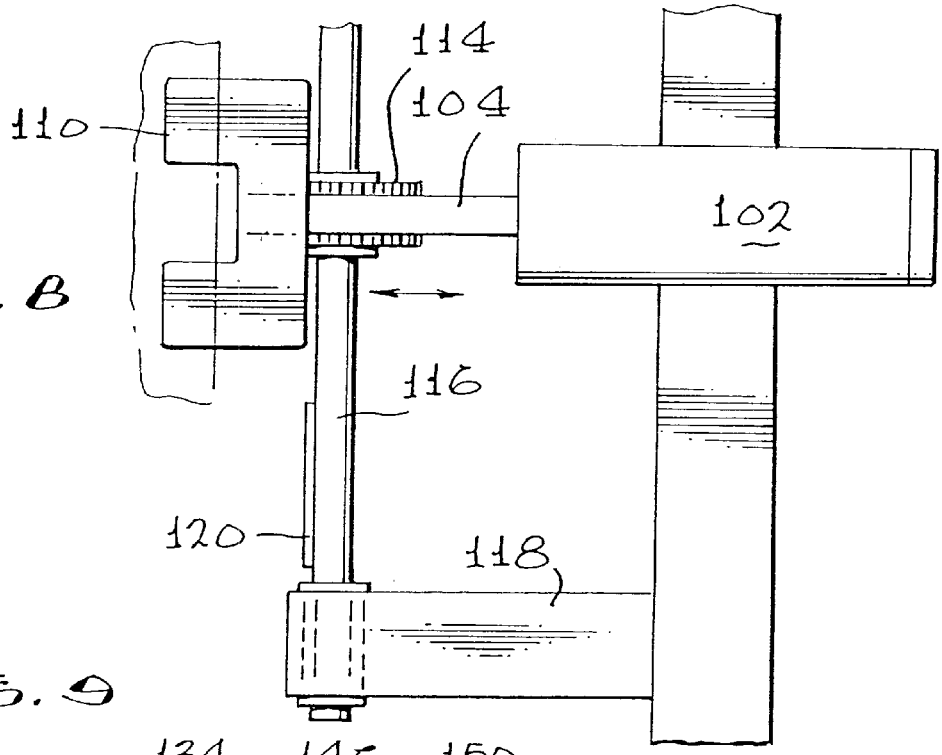
FIG. 8 is a detail showing a top view of the alternate embodiment of the device of FIG. 7 with a feeder portion that is activated by pneumatic or hydraulic means.

FIGS. 7 and 8 are details showing a side and top view of an alternate embodiment of the device 10 showing a portion of feeder portion 100 that is activated by pneumatic or hydraulic means. The pneumatic or hydraulic means includes a pneumatic or hydraulic cylinder 102 that moves a slide bar 104 in response to movement of gas or liquid through inlet 106 and outlet 108. Inlet 106 and outlet 108 are connected to sources of pressurized gas and fluid (not shown) and further include valve means (also not shown). The slide bar 104 is connected to upper feeder support 110. Slide bar 104 has a ratchet surface 112 that engages with a ratchet gear 114. Ratchet gear 114 is positioned on an axle 116 that is rotatably positioned in standoffs 118. Lower feeder support 120 is affixed to axle 116. As with the first embodiment of feeder portion 22, movement of slide bar 104 moves both the upper feeder support 100 and lower feeder support 120. Each feeder portion 100 can have its own pneumatic or hydraulic cylinder 104, or alternately, the axles 116 of adjacent sections of the feeder portion 100 can be moveably connected with bevel gears in the same manner as that of the first embodiment of feeder portion 22.

Figure 9:
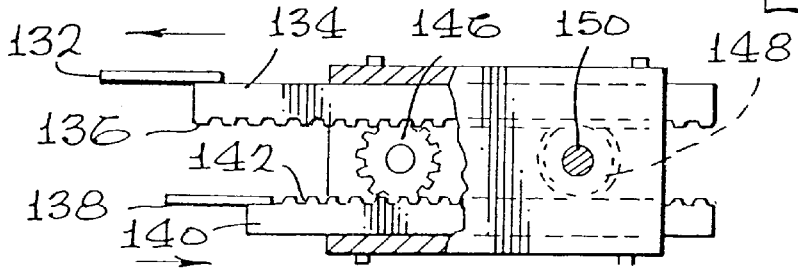
FIG. 9 is a detail showing a side view of yet another alternate embodiment of the feeder portion of the device.

FIG. 9 is a detail showing a side view of yet another alternate embodiment of the feeder portion 130 of the device 10. The third embodiment of the feeder portion 130 is different than the other embodiments with their a lower feeder support which pivots between a generally horizontal position and a dropped down vertical position. In the third embodiment, an upper feeder support 132 is connected to an upper slide bar 134 with a lower ratchet surface 136 and a lower feeder support 138 is connected to a lower slide bar 140 with an upper ratchet surface 142. The upper and lower slide bars 134 and 140 are placed in a slide bar housing 144 with ratchet gears 146 and 148 riding on the lower ratchet surface 136 and upper ratchet surface 142. Ratchet gear 148 has a drive axle 150 that is turned as previously described with reference to the other embodiments. When drive axle 150 is turned counterclockwise, upper feeder support 132 moves inwardly and lower feeder support 138 moves outwardly. When drive axle 150 is turned clockwise, upper feeder support 132 moves outwardly and lower feeder support 138 moves inwardly. In other respects, the third embodiment of the feeder portion 130 is the same as with the other described embodiments of feeder portions.

Figure 10:
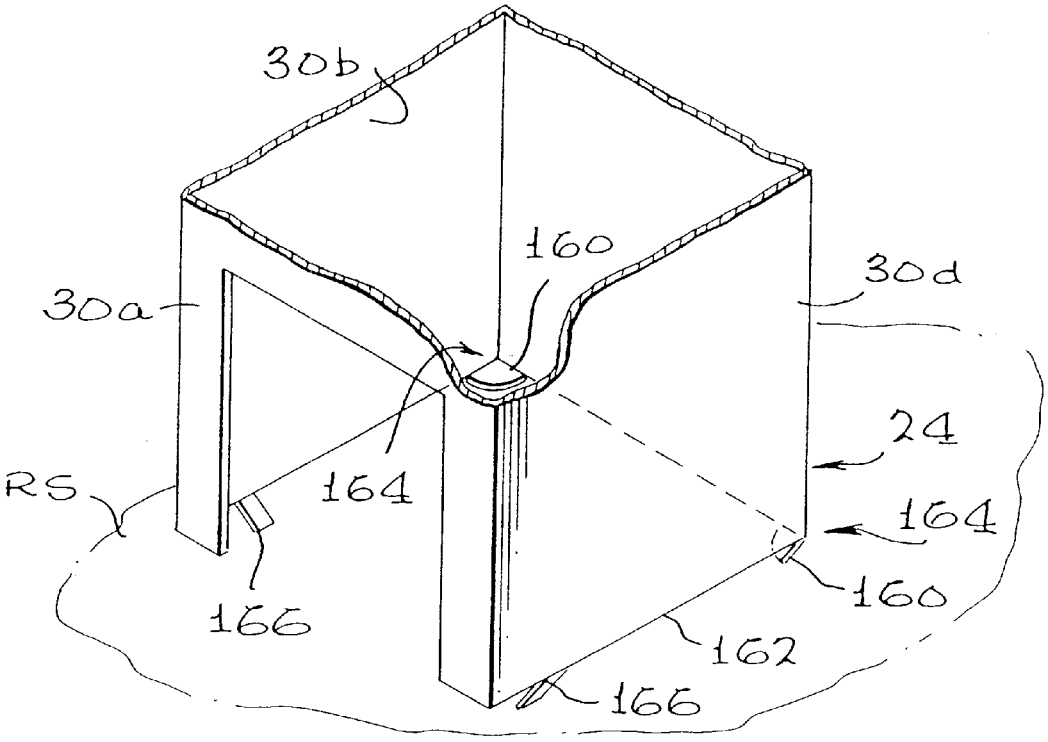
FIG. 10 is a perspective detail view showing optional cone shock absorbers mounted in the chute.

Turning now to FIG. 10, a perspective detail view is shown of an optional cone shock absorber 160 mounted at the bottom end 162 if chute 24 near rear corners 164 thereof. These cone shock absorbers 160 are conveniently made of flexible material, such as rubber, soft plastic, but and can also comprise spring loaded traps (not shown.) The cone shock absorbers 160 extend into the chute 24 and provide a contract surface upon which the base of the cone will impinge as it drops through the chute 24. The cone shock absorbers 160 act to decelerate cones dropped through chute 24 just before cones hit the roadway surface RS, thereby helping to prevent the cones from bouncing up, to the front or rear, or from side to side, thereby helping to ensure the cones are placed upright on the roadway surface RS. Additional optional cone shock absorbers 166 can be placed at the bottom end 162 of side walls 30*b* and 30*d* of chute 24 close to front wall 30*a*. These optional cone shock absorbers 166 also extend into the chute 24 and likewise assist in slowing down the front edge of the cone that first contacts the roadway surface RS.

The drawings and the foregoing description are not intended to represent the only form of the invention in regard to the details of this construction and manner of operation. In fact, it will be evident to one skilled in the art that modifications and variations may be made without departing from the spirit and scope of the invention. Although specific terms have been employed, they are intended in a generic and descriptive sense only and not for the purpose of limitation.

I claim:

1. A device for setting cones on a roadway surface, the cones having a lower base portion and an upwardly extending cone extension, the device being detachably attachable to a pickup truck, comprising:

a chute portion having an upper end and a lower end;

a feeder portion adapted to release cones one at a time from the upper end of the chute portion to the lower end of the chute portion to set cones on a roadway surface;

motive means to activate the feeder portion;

a control means to control the motive means; and a means for attaching the device to a pickup truck, wherein the means for attaching comprises arms for supporting the device on a tailgate of a pickup truck.

2. The device for setting cones on a roadway surface of claim 1, wherein the upper end of the chute portion comprises a hopper portion adapted for holding a plurality of stacked cones above the feeder portion, wherein in the plurality of stacked cones the base portions are spaced apart.

3. The device for setting cones on a roadway surface of claim 1, wherein the feeder portion comprises a plurality of feeder support units, each feeder support unit having an upper feeder support and a lower feeder support, the upper feeder support and lower feeder support being spaced apart, the upper feeder support being movable between an extended position and a retracted position, the lower feeder support being movable between an extended position and a retracted position, and the upper feeder support and lower feeder support being movable in concert by the motive means such that when the upper feeder support is in the extended position, the lower feeder support is in the retracted position, and when the upper feeder support is in the retracted position, the lower feeder support is in the extended position, and wherein one cycle of the feeder portion to release one cone comprises the upper feeder supports first being in the extended position with the lower feeder supports being in the retracted position to allow a lower cone in a stack of nested cones to drop through the chute portion while the stack of cones above the lower cone is supported by the base portion of the second to lowest cone resting on the upper feeder supports, the upper feeder supports next being in the retracted position with the lower feeder supports being in the extended position to allow the base portion of the now lowest cone in the stack of nested cones to drop onto the lower feeder supports.

4. The device for setting cones on a roadway surface of claim 3, wherein each feeder support unit further comprises a gear on an axle, the upper feeder support having a ratchet surface which engages and is moved between the extended and retracted positions along a generally horizontal plane by rotation of the gear, and wherein the lower feeder support is affixed to the axle, and wherein when the upper feeder support is moved by the gear to the extended position which is generally horizontal and projecting inwardly under the base of the second to lowest cone, the lower feeder support moves to its retracted position pointing generally downwardly out of the way of the base of the lowest cone, and when the upper feeder support is moved by the gear to the retracted position projecting outwardly away from the cone, the lower feeder support moves inwardly to its extended position under the cone.

5. The device for setting cones on a roadway surface of claim 4, wherein four feeder support units are provided in a spaced apart relationship inside the chute portion, and wherein the axles are movably geared together so as to move all of the upper feeder supports and lower feeder supports in unison, and wherein the motive means comprises a reversible electrical motor.

6. The device for setting cones on a roadway surface of claim 3, wherein each feeder support unit further comprises a gear on an axle, the upper feeder support and the lower feeder supports having ratchet surfaces which are engaged with the gears and move between their extended and retracted positions along generally horizontal planes by rotation of the gears, and wherein when the upper feeder supports are moved by the gears to the extended position projecting under the base of the second to lowest cone, the lower feeder supports are moved to the retracted position away from the base portion of the lowest cone to allow the lowest cone to drop through the chute portion, and when the upper feeder supports are moved by the gears to the retracted position away from the base portion of the second to lowest cone, the lower feeder supports are moved inwardly to the extended position under the base portion of the second to lowest cone.

7. The device for setting cones on a roadway surface of claim 6, wherein four feeder support units are provided in a spaced apart relationship inside the chute portion, and wherein the axles are movably geared together so as to move all of the upper feeder supports and lower feeder supports in unison, and wherein the motive means comprises a reversible electrical motor.

8. The device for setting cones on a roadway surface of claim 3, wherein the motive means comprises a reversible electric motor, and the control means comprises sensor switches for detecting the retracted position of the upper feeder supports and the retracted position of the lower feeder supports, the sensor switches being connected to control circuitry for turning on and off and reversing the direction of the reversible electric motor, the control circuitry further comprising adjustable delay circuitry for setting an adjustable delay in time between cycles of operation of the feeder portion.

9. The device for setting cones on a roadway surface of claim 3, wherein the control means further comprising a distance measuring sensor means adapted to measure the distance the vehicle has traveled, and an adjustment switch to set the spacing distance between the cones set on a roadway.

10. The device for setting cones on a roadway surface of claim 3, wherein the motive means comprises pneumatic valves, pneumatic cylinders and a gas pressure supply.

11. The device for setting cones on a roadway surface of claim 3, wherein the motive means comprises hydraulic valves, hydraulic cylinders and a pressurized hydraulic fluid supply.

12. The device for setting cones on a roadway surface of claim 1, wherein the chute portion comprises a back wall, two side walls, and a front wall, the back wall, two side walls, and a front wall being spaced apart such that the base portion of a cone will freely pass therethrough, and wherein the front wall has a cutout sized to allow the upwardly extending cone extension of the cone to freely pass therethrough when the cone drops on a roadway surface.

13. The device for setting cones on a roadway surface of claim 1, further comprising a conveyor portion for delivering and depositing stacks of cones into the upper end of the chute portion.

14. The device for setting cones on a roadway surface of claim 1, further comprising cone shock absorbers that are located at the lower end of the chute and which extend into the chute, wherein the cone shock absorbers act to decelerate cones dropping through the bottom of the chute.

15. A device for setting cones on a roadway surface, the cones having a lower base portion and an upwardly extending cone extension, the device comprising:

a chute portion having an upper end and a lower end;

a feeder portion adapted to release cones one at a time from the upper end of the chute portion to the lower end of the chute portion to set cones on a roadway surface;

a hopper portion adapted for holding a plurality of stacked cones above the feeder portion, wherein in the plurality of stacked cones the base portions are spaced apart;

motive means to activate the feeder portion;

control means to control the motive means; and means to detachably attach the device to a truck to permit a truck to be fitted with the device and for the device to be removed from the truck when not in use.

16. The device for setting cones on a roadway surface of claim 15, wherein the feeder portion comprises a plurality of feeder support units, each feeder support unit having an upper feeder support and a lower feeder support, the upper feeder support and lower feeder support being spaced apart, the upper feeder support being movable between an extended position and a retracted position, the lower feeder support being movable between an extended position and a retracted position, and the upper feeder support and lower feeder support being movable in concert by the motive means such that when the upper feeder support is in the extended position, the lower feeder support is in the retracted position, and when the upper feeder support is in the retracted position, the lower feeder support is in the extended position, and wherein one cycle of the feeder portion to release one cone comprises the upper feeder supports first being in the extended position with the lower feeder supports being in the retracted position to allow a lower cone in a stack of nested cones to drop through the chute portion while the stack of cones above the lower cone is supported by the base portion of the second to lowest cone resting on the upper feeder supports, the upper feeder supports next being in the retracted position with the lower feeder supports being in the extended position to allow the base portion of the now lowest cone in the stack of nested cones to drop onto the lower feeder supports.

17. A device for setting cones on a roadway surface, the cones having a lower base portion and an upwardly extending cone extension, the device comprising:

a chute portion having an upper end and a lower end, a back wall, two side walls, and a front wall, the back wall, two side walls, and a front wall being spaced apart such that the base portion of a cone will freely pass therethrough, and wherein the front wall has a cutout sized to allow the upwardly extending cone extension of the cone to freely pass therethrough when the cone drops on a roadway surface;

a feeder portion adapted to release cones one at a time from the upper end of the chute portion to the lower end of the chute portion to set cones on a roadway surface;

motive means to activate the feeder portion;

a control means to control the motive means.

18. A device for setting cones on a roadway surface, the cones having a lower base portion and an upwardly extending cone extension, the device comprising:

a chute portion having an upper end and a lower end;

a conveyor portion for delivering and depositing cones into the upper end of the chute portion;

a feeder portion adapted to release cones one at a time from the upper end of the chute portion to the lower end of the chute portion to set cones on a roadway surface;

motive means to activate the feeder portion; and control means to control the motive means.

19. A device for setting cones on a roadway surface, the cones having a lower base portion and an upwardly extending cone extension, the device comprising:

a chute portion having an upper end and a lower end;

a conveyor portion for delivering and depositing cones into the upper end of the chute portion;

cone shock absorbers that are located at the lower end of the chute and which extend into the chute, wherein the cone shock absorbers act to decelerate cones dropping through the lower end of the chute;

a feeder portion adapted to release cones one at a time from the upper end of the chute portion to the lower end of the chute portion to set cones on a roadway surface;

motive means to activate the feeder portion; and control means to control the motive means.

20. A device for setting cones on a roadway surface, the cones having a lower base portion and an upwardly extending cone extension, the device comprising:

a chute portion having an upper end and a lower end;

a feeder portion adapted to release cones one at a time from the upper end of the chute portion to the lower end of the chute portion to set cones on a roadway surface, the feeder portion comprising feeder support units having an upper feeder support and a lower feeder support, the upper feeder support and lower feeder support being spaced apart, the upper feeder support being movable between an extended position and a retracted position, the lower feeder support being movable between an extended position and a retracted position, and the upper feeder support and lower feeder support being movable in concert by the motive means such that when the upper feeder support is in the extended position, the lower feeder support is in the retracted position, and when the upper feeder support is in the retracted position, the lower feeder support is in the extended position, and wherein one cycle of the feeder portion to release one cone comprises the upper feeder supports first being in the extended position with the lower feeder supports being in the retracted position to allow a lower cone in a stack of nested cones to drop through the chute portion while the stack of cones above the lower cone is supported by the base portion of the second to lowest cone resting on the upper feeder supports, the upper feeder supports next being in the retracted position with the lower feeder supports being in the extended position to allow the base portion of the now lowest cone in the stack of nested cones to drop onto the lower feeder supports;

motive means to activate the feeder portion; and control means to control the motive means.

21. A device for setting cones on a roadway surface, the cones having a lower base portion and an upwardly extending cone extension, the device comprising:

a chute portion having an upper end and a lower end;

a feeder portion for releasing cones one at a time from the upper end of the chute portion to the lower end of the chute portion to set cones on a roadway surface, the feeder portion comprising feeder support units having an upper feeder support and a lower feeder support, the upper feeder support and lower feeder support being spaced apart, the upper feeder support being movable between an extended position and a retracted position, the lower feeder support being movable between an extended position and a retracted position, and the upper feeder support and lower feeder support being movable in concert by the motive means such that when the upper feeder support is in the extended position, the lower feeder support is in the retracted position, and when the upper feeder support is in the retracted position, the lower feeder support is in the extended position;

motive means to activate the feeder portion; and control means to control the motive means.

* * * * *